US009080527B2

(12) United States Patent
Wilms et al.

(10) Patent No.: US 9,080,527 B2
(45) Date of Patent: Jul. 14, 2015

(54) METHOD AND DEVICE FOR CONTROLLING A QUANTITY CONTROL VALVE

(75) Inventors: Rainer Wilms, Markgroeningen (DE); Matthias Schumacher, Weissach (DE); Joerg Kuempel, Ludwigsburg (DE); Matthias Maess, Boeblingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 218 days.

(21) Appl. No.: 13/508,816

(22) PCT Filed: Oct. 14, 2010

(86) PCT No.: PCT/EP2010/065383

§ 371 (c)(1),
(2), (4) Date: Aug. 3, 2012

(87) PCT Pub. No.: WO2011/061017

PCT Pub. Date: May 26, 2011

(65) Prior Publication Data

US 2013/0032738 A1 Feb. 7, 2013

(30) Foreign Application Priority Data

Nov. 18, 2009 (DE) ..... 10 2009 046 825

(51) Int. Cl.
*F02M 59/36* (2006.01)
*F02D 41/20* (2006.01)
*F02M 63/00* (2006.01)

(52) U.S. Cl.
CPC ..... *F02D 41/20* (2013.01); *F02M 59/366* (2013.01); *F02M 59/368* (2013.01); *F02M 63/0003* (2013.01); *F02M 63/0007* (2013.01)

(58) Field of Classification Search
CPC ..... F02M 59/366; F02M 59/368; F02M 63/0003; F02M 63/0007; F02D 41/20
USPC ..... 137/14; 251/129.04, 129.15; 123/446, 123/457, 458, 497, 499, 500, 508, 511
See application file for complete search history.

(56) References Cited

U.S. PATENT DOCUMENTS 5,201,294 A * 4/1993 Osuka ..... 123/458
5,975,053 A * 11/1999 Rodier ..... 123/446

(Continued)

FOREIGN PATENT DOCUMENTS

DE 101 48 218 4/2003
DE 10 2007 035 316 1/2009

(Continued)

OTHER PUBLICATIONS

International Search Report for PCT/EP2010/065383, dated Feb. 4, 2011.

*Primary Examiner* — Matthew W Jellett
(74) *Attorney, Agent, or Firm* — Kenyon & Kenyon LLP

(57) ABSTRACT

In a fuel injection system of an internal combustion engine, fuel is delivered from a high-pressure pump into a fuel rail. The quantity of the delivered fuel is influenced by a quantity control valve which is activated by an electromagnetic actuating device. The level of control of the quantity control valve during the transition from the closed state to the open state of the quantity control valve is provided in the form of a sufficiently flat, descending progression which allows a robust control of the opening motion with regard to the varying specimen properties.

15 Claims, 5 Drawing Sheets

(56) References Cited

U.S. PATENT DOCUMENTS

| | | | | |
|---|---|---|---|---|
| 6,237,573 | B1 * | 5/2001 | Onishi et al. | 123/506 |
| 6,332,454 | B1 * | 12/2001 | Itabashi et al. | 123/490 |
| 7,299,790 | B2 * | 11/2007 | Okamoto et al. | 123/506 |
| 7,325,537 | B2 * | 2/2008 | Mueller et al. | 123/506 |
| 7,387,109 | B2 * | 6/2008 | Rembold et al. | 123/446 |
| 7,591,239 | B2 * | 9/2009 | Okamoto | 123/179.17 |
| 7,757,667 | B2 * | 7/2010 | Okamoto et al. | 123/499 |
| 7,757,669 | B2 * | 7/2010 | Okamoto et al. | 123/508 |
| 8,256,398 | B2 * | 9/2012 | Akita et al. | 123/334 |
| 8,315,780 | B2 * | 11/2012 | Toyohara et al. | 701/105 |
| 8,662,056 | B2 * | 3/2014 | Fedor et al. | 123/446 |
| 2002/0170539 | A1 * | 11/2002 | Rembold et al. | 123/458 |
| 2008/0198529 | A1 * | 8/2008 | Rembold | 361/195 |
| 2008/0234916 | A1 * | 9/2008 | Koehler et al. | 701/103 |
| 2010/0237266 | A1 | 9/2010 | Haaf et al. | |
| 2011/0295493 | A1 * | 12/2011 | Wilms et al. | 701/103 |
| 2014/0158205 | A1 * | 6/2014 | Tanabe et al. | 137/1 |

FOREIGN PATENT DOCUMENTS

| | | |
|---|---|---|
| DE | 10 2009 026 690 | 12/2009 |
| DE | 10 2008 054 512 | 6/2010 |
| WO | WO 2006/060545 | 6/2006 |
| WO | WO 2009/016044 | 2/2009 |
| WO | WO 2010/066663 | 6/2010 |
| WO | WO 2010/072536 | 7/2010 |

* cited by examiner

METHOD AND DEVICE FOR CONTROLLING A QUANTITY CONTROL VALVE

BACKGROUND OF THE INVENTION

1. Field of the Invention

The present invention relates to a device and a method for controlling a quantity control valve.

2. Description of Related Art

Published German patent application document DE 101 48 218 A1 describes a method for operating a fuel injection system using a quantity control valve. The known quantity control valve is implemented as a solenoid valve which has an armature and associated path limiting stops and which is electromagnetically activated by a magnetic coil. Quantity control valves of this type which are closed in the de-energized state of the magnetic coil are known from the market. In this case, for opening the quantity control valve the magnetic coil is controlled by a constant voltage or a clocked voltage (pulse width modulation (PWM)), causing the current in the magnetic coil to increase in a characteristic manner. After the voltage is switched off, the current drops back in a characteristic manner, causing the quantity control valve to close. Solenoid valves are also known which are open in the energized state of the coil. These solenoid valves are operated in a similar manner in which the solenoid valve opens when the voltage is switched off and the current undergoes a characteristic drop.

For the valve, which is closed in the de-energized state, disclosed in published German patent application document DE 101 48 218 A1, in order to prevent the armature from striking against the stop at full speed during the opening motion of the quantity control valve, which could result in significant noise generation, the electromagnetic actuating device is energized once again in a pulsed manner shortly before the opening motion ends. As a result of this current pulse, a decelerating force is exerted on the armature before it contacts the stop. The decelerating force causes the speed to be reduced, thus decreasing the noise from the stop.

Since the properties of the quantity control valve are different from one specimen to another, for the most effective reduction possible of the noise from the stop it is advantageous when the effect of the energization is not a function of the specimen properties.

German patent application document DE 10 2008 054 512, not pre-published, proposes that at least one parameter of the braking pulse is adapted to the specimen properties for controlling a quantity control valve which is activated by an electromagnetic actuating device.

However, this method imposes great demands on the control/regulation device on which the method is implemented. A less complicated method is desirable for reducing the demands on the control/regulation device.

BRIEF SUMMARY OF THE INVENTION

The present invention provides a quantity control valve which assumes a closed state when controlled by a first control value, and which is able to assume an open state when controlled by a second control value.

The control according to the present invention, in which the control signal drops from a first signal value at a first point in time to a second signal value at a second point in time, allows the opening motion of the quantity control valve to be retarded in a particularly simple, robust manner.

To allow the opening motion of the quantity control valve to be controlled until the quantity control valve is completely open, it is advantageous that the control signal drops from this second signal value at this second point in time to the second control value at a third point in time.

To devise a robust opening motion with respect to varying specimen properties, it is advantageous that the quantity control valve is in the closed state for control signals above the first signal value, since according to the present invention this ensures that the quantity control valve is in the closed state for all specimens of the quantity control valve.

To devise a robust opening motion with respect to varying specimen properties, it is advantageous that the quantity control valve is not in the closed state for control signals below the second signal value, since according to the present invention this ensures that the quantity control valve is allowed to open for all specimens of the quantity control valve.

To devise a robust opening motion with respect to varying specimen properties, it is advantageous that control signals below the second control value allow the quantity control valve to assume the open state, since according to the present invention this ensures that the quantity control valve is allowed to assume the open state for all specimens of the quantity control valve.

The high pressure in the delivery space holds the quantity control valve in its closed state. To limit power loss, it is advantageous when the control signal is temporarily below the second control value from the point in time when the quantity control valve closes until the first point in time.

To devise the control in a particularly simple manner, it is advantageous when the control signal is continuously above the second control value from the point in time when the quantity control valve closes until the first point in time.

If the time interval between the third point in time and the second point in time is greater, by a first factor, than the time required for the quantity control valve to transition from the closed state to the open state at a control signal below the second control value, it is thus ensured that the descending progression of the control signal is sufficiently flat to effectively retard the opening motion of the quantity control valve.

If the time interval between the second point in time and the first point in time is greater, by a second factor, than the time required for the quantity control valve to transition from the closed state to the open state at a control signal below the second control value, it is thus ensured that the descending progression of the control signal is sufficiently flat to effectively retard the opening motion of the quantity control valve.

To prevent the actuator from exerting an excessively low force on the activating plunger of the quantity control valve at the point in time when the quantity control valve is no longer held in its closed position by the pressure in the delivery space, it is advantageous when the first point in time and/or the second point in time is/are after a top dead center of a high-pressure pump or after the point in time when an outlet valve opens.

The method according to the present invention may be implemented in a particularly simple manner when the quantity control valve is combined with an electromagnetic actuator, and the first control value of the control signal corresponds to an energized state of the actuator, and the second control value of the control signal corresponds to a de-energized state.

The method according to the present invention is cost-effective as an implementable measure, since no additional costs per unit arise.

DETAILED DESCRIPTION OF THE INVENTION

Figure 1:
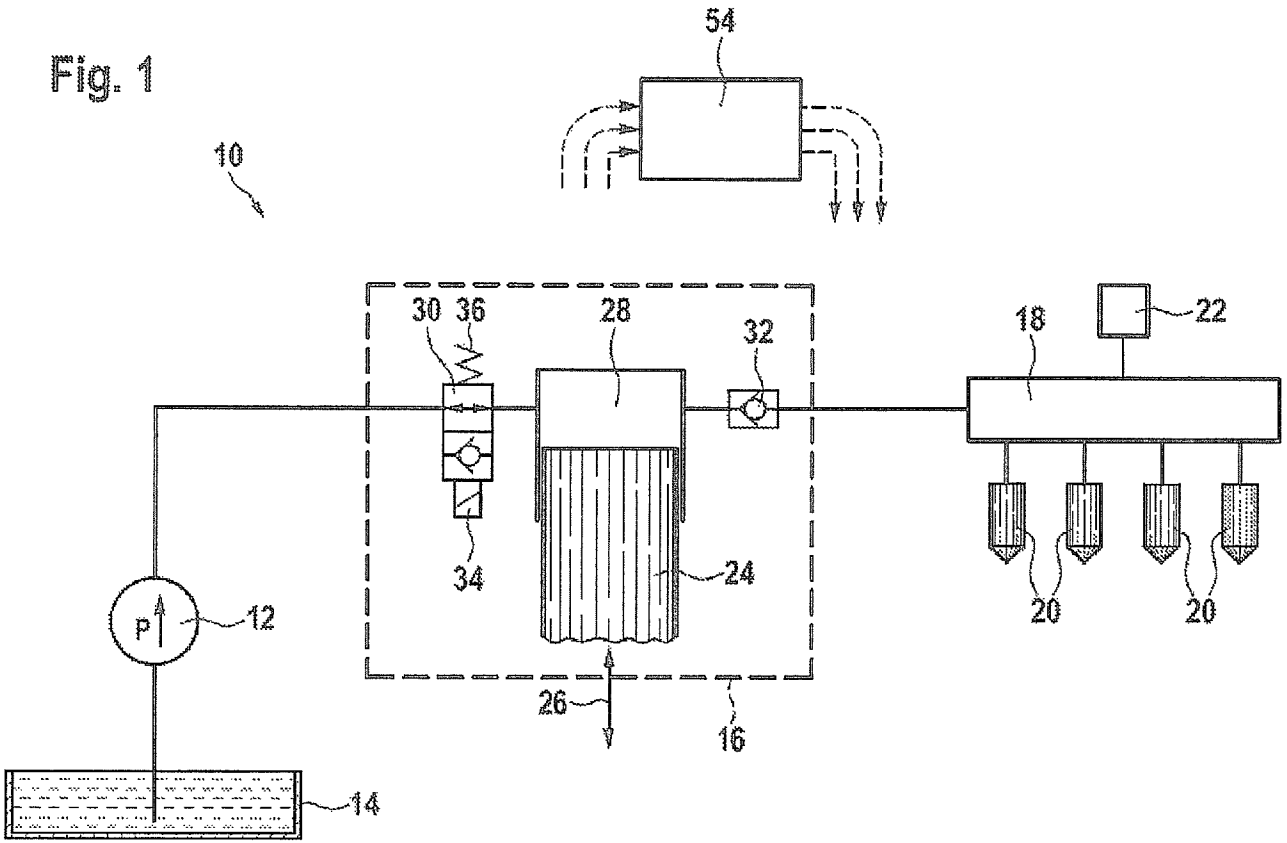
FIG. 1 shows a schematic illustration of a fuel injection system of an internal combustion engine having a high-pressure pump and a quantity control valve.

A fuel injection system is denoted overall by reference numeral 10 in FIG. 1. The fuel injection system includes an electric fuel pump 12 via which fuel is delivered from a fuel tank 14 to a high-pressure pump 16. High-pressure pump 16 compresses the fuel to a very high pressure and delivers it onward into a fuel rail 18. Multiple injectors 20 are connected to the fuel rail which inject the fuel into assigned combustion chambers. The pressure in fuel rail 18 is detected by a pressure sensor 22.

High-pressure pump 16 is a reciprocating pump having a delivery piston 24 which may be set into a back-and-forth motion (double arrow 26) by a camshaft, not shown. Delivery piston 24 delimits a delivery space 28, which may be connected to the outlet of electric fuel pump 12 via a quantity control valve 30. Delivery space 28 may also be connected to fuel rail 18 via an outlet valve 32.

Quantity control valve 30 includes, for example, an electromagnetic actuating device 34 which in the energized state works against the force of a spring 36. In the form of the exemplary embodiment, quantity control valve 30 is open in the de-energized state, and in the energized state has the function of a standard inlet check valve.

Figure 2:
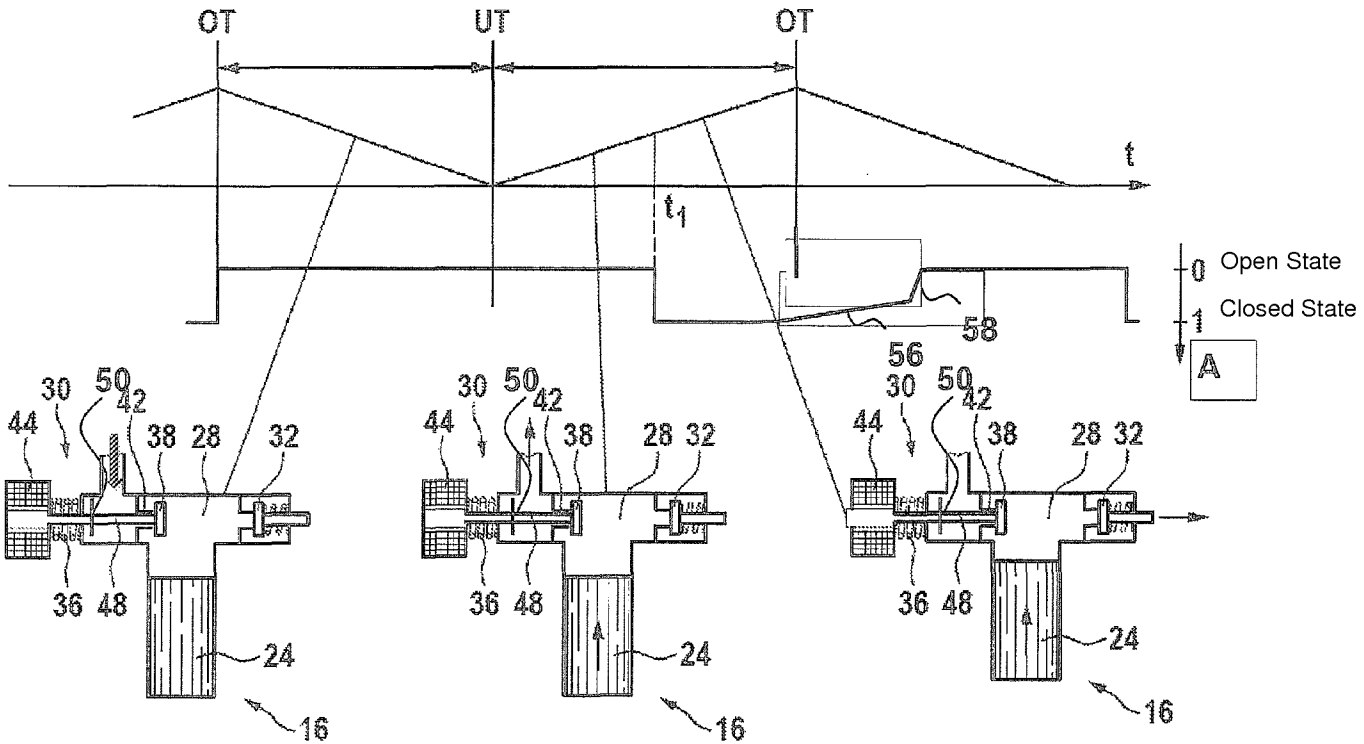
FIG. 2 shows a schematic illustration of various functional states of the high-pressure pump and of the quantity control valve from FIG. 1, together with an associated time diagram.

High-pressure pump 16 and quantity control valve 30 operate as follows (see FIG. 2):

A stroke of piston 24 is plotted in the upper part of FIG. 2, and therebelow a control signal is plotted as a function of time. The control signal is denoted by reference character A. The value of the control signal is between a first control value, denoted by "0" in FIG. 2, and a second control value, denoted by "1" in FIG. 2. For example, the first control value corresponds to the de-energized state of electromagnetic actuating device 34, and the second value corresponds to the energized state. The following discussion is based on this exemplary embodiment.

In addition, high-pressure pump 16 is schematically shown in various operating states. During an intake stroke (left illustration in FIG. 2) magnetic coil 44 is de-energized, as the result of which activating plunger 48 is pressed against valve element 38 by spring 36 and moves the valve element into its open position. Fuel is thus able to flow from electric fuel pump 12 into delivery space 28. After bottom dead center UT is reached, the delivery stroke of delivery piston 24 begins. This is illustrated in the middle diagram in FIG. 2. Magnetic coil 44 continues to be de-energized, as the result of which quantity control valve 30 remains open by force. The fuel is ejected by delivery piston 24 to electric fuel pump 12 via open quantity control valve 30. Outlet valve 32 remains closed. Delivery into fuel rail 18 does not take place. Magnetic coil 44 is energized at a point in time t1, causing activating plunger 48 to be pulled away from valve element 38. It is noted at this point that the progression over time of the energization of magnetic coil 44 is only schematically illustrated in FIG. 2. It is noted that the actual coil current is not constant, but, rather, drops under some circumstances due to mutual induction effects. Furthermore, for a pulse width-modulated control voltage the coil current is wave- or tooth-shaped.

The fuel quantity delivered by high-pressure pump 16 to fuel rail 18 is influenced by varying point in time t1. Point in time t1 is set by a control and regulation device 54 (FIG. 1) in such a way that an actual pressure in fuel rail 18 corresponds as closely as possible to a setpoint pressure. For this purpose, signals delivered by pressure sensor 22 are processed in control and regulation device 54.

Due to the pressure in delivery space 28, valve element 38 rests against valve seat 42; i.e., quantity control valve 30 is closed. A pressure is now able to build up in delivery space 28 which results in opening of outlet valve 32 and delivery into fuel rail 18. This is illustrated at the far right in FIG. 2. Shortly after top dead center OT of delivery piston 24 is reached, the energization of magnetic coil 44 is terminated, causing quantity control valve 30 to return to its forced open position.

When the energization of magnetic coil 44 is terminated, activating plunger 48 is moved against a first stop 50. To reduce the impact speed at first stop 50, a descending signal progression 56 is generated which reduces the speed of motion of activating plunger 48 before striking first stop 50. The control signal is brought to the first control value during a second descending signal progression 58. This second descending signal progression 58 may be provided, for example, by rapid extinction of the coil current of electromagnetic actuating device 34.

Figure 3:
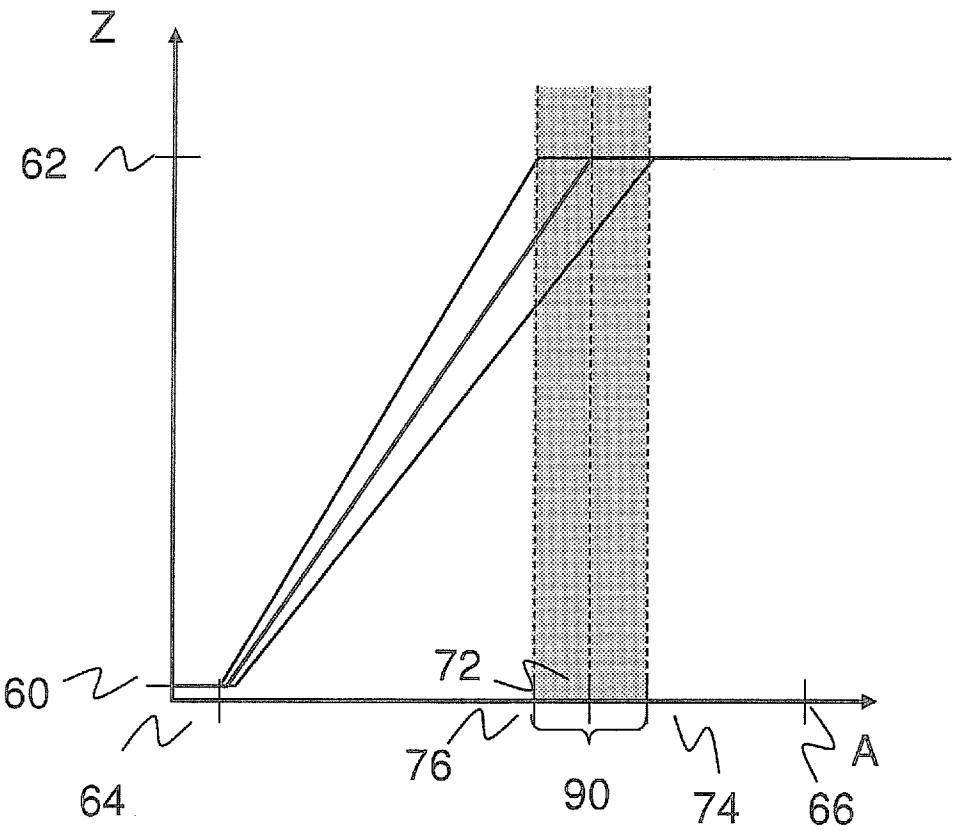
FIG. 3 shows a schematic illustration of the relationship between the control signal and the state of the quantity control valve.

Reference is now made to FIG. 3, in which the relationship between the control signal, denoted by A, and the state of quantity control valve 30, denoted by Z, is illustrated. In the exemplary embodiment, the state is characterized by a stroke of activating plunger 38. In the exemplary embodiment, a value of the control signal corresponds to a force exerted on activating plunger 38 by electromagnetic actuating device 34, and thus, to a stroke of activating plunger 38, and consequently, to a state of quantity control valve 30. For a first control value 66 (in the exemplary embodiment, corresponding, for example, to the energized state of electromagnetic actuating device 34), quantity control valve 30 is in closed state 62, and for second control value 64 (in the exemplary embodiment, corresponding, for example, to the de-energized state of the electromagnetic state of electromagnetic actuating device 34), quantity control valve 30 is in open state 60. When the control signal is changed (in the exemplary embodiment, reduced) in the direction of the second control value starting from first control value 66, quantity control valve 30 begins to open at a limiting control value 72. A variance range 90 of the limiting control value between an upper variance limit 74 and a lower variance limit 76 results due to the properties of the quantity control valve which differ from one specimen to another.

Figure 4:
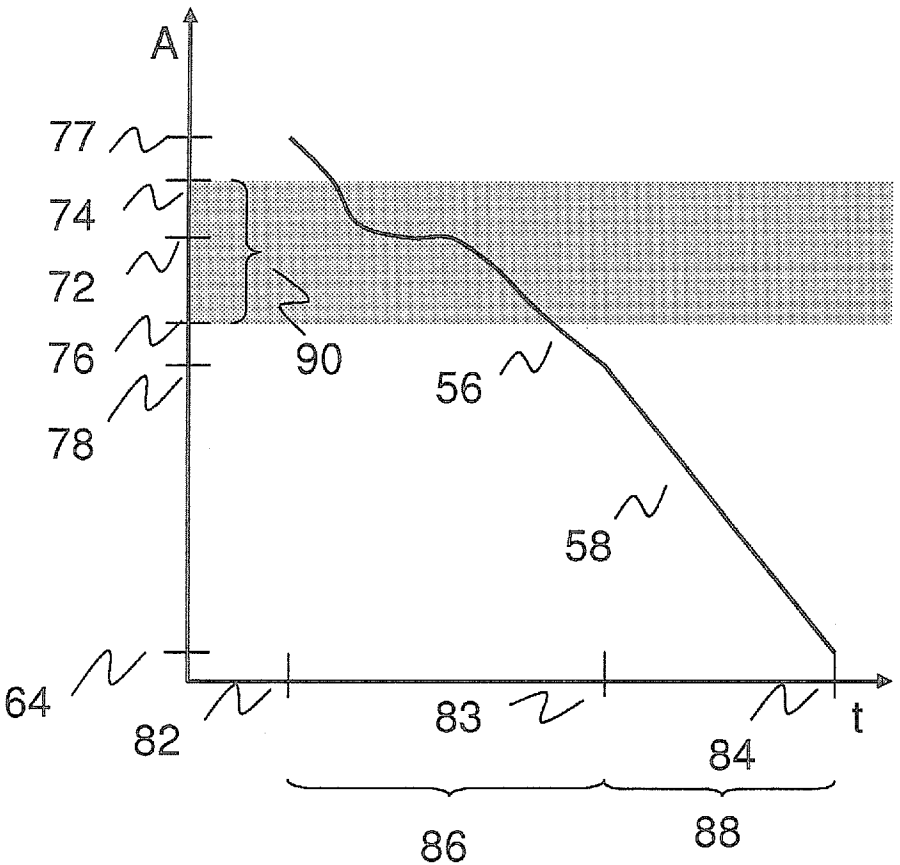
FIG. 4 shows a schematic illustration of the progression over time of the control signal.

FIG. 4 shows the progression according to the present invention of control signal A over time t during descending signal progression 56. At a first point in time 82 the value of the control signal is equal to a first signal value 77, and at a second point in time 83 the value of the control signal is equal to a second signal value 78. At a third point in time 84 the value of the control signal is equal to the second control value. According to the present invention, first signal value 77 is greater than upper variance limit 74. Thus, it is ensured for all specimens of quantity control valve 30 that the quantity control valve is in the closed state at first point in time 82. According to the present invention, second signal value 78 is less than lower variance limit 76. Thus, it is ensured for all specimens of quantity control valve 30 that the quantity control valve is able to transition into the open state at second point in time 83, if, as described above, quantity control valve 30 is not held in the closed state by the pressure in delivery space 28, for example. When quantity control valve 30 is not held in the closed state, for example by the pressure in delivery space 28, at point in time 83 it is ensured that all specimens of quantity control valve 30 begin to open, i.e., that activating plunger 48 is set in motion. After third point in time 84, the value of the control signal has dropped to second control value 64, so that the quantity control valve is not able to completely open until shortly before third point in time 84. As the result of the motion of activating plunger 48, a magnetic field is induced in magnetic coil 44 which generates a counterforce on activating plunger 48. According to the present invention, at second point in time 83 a magnetic counterforce induced by the motion of activating plunger 48 is generated on all specimens of quantity control valve 30, and a force acts which corresponds to the state of quantity control valve 30, i.e., the value of the control signal.

According to the present invention, it is recognized that the motion of the activating plunger may be retarded as the result of a sufficiently flat first descending signal progression 56 and/or a sufficiently flat second descending signal progression 58 in such a way that the emission of audible sound upon striking first stop 50 is reduced. According to the present invention, it is recognized that this sufficiently flat progression may be achieved as the result of a sufficiently large first time interval 86 between second point in time 83 and first point in time 82, and/or as the result of a sufficiently large time interval 88 between third point in time 84 and second point in time 83. For example, first time interval 86 and/or second time interval 88 should be selected to be greater, by a factor, than the time required for quantity control valve 30 to close when controlled by second control value 64. This factor may be 1, 2, 5, or 10, for example. However, it is also possible, for example, to select time period 88 to be short (for example, to represent the second descending progression by a rapid extinction) when it is ensured that quantity control valve 30 is sufficiently closed at second point in time 83. According to the present invention, it is recognized that this may be achieved, for example, by a sufficiently low second signal value 78.

Figure 5:
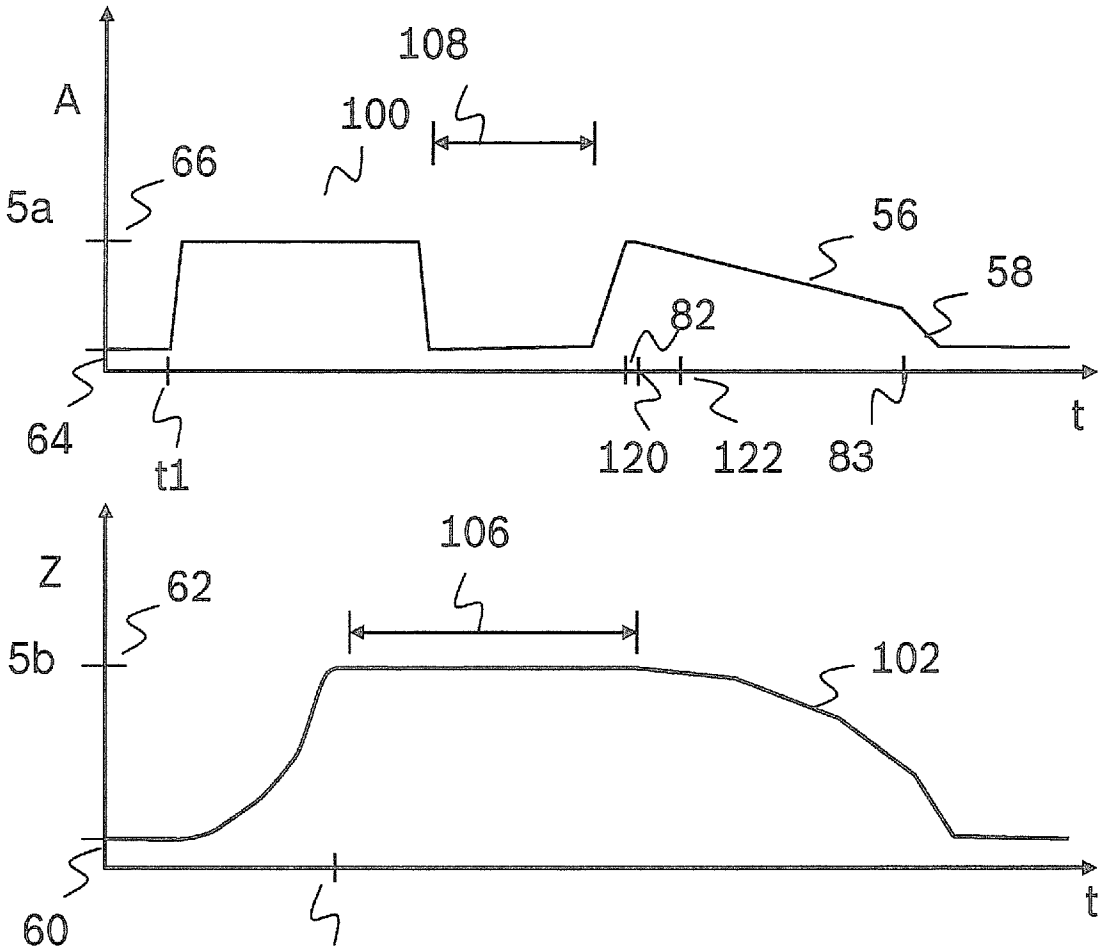
FIG. 5 shows a second schematic illustration of the progression over time of the control signal and of the progression over time of the state of the quantity control valve.

FIG. 5 shows progression over time 100 of the control signal, denoted by A, and progression over time 102 of the state of quantity control valve 30, denoted by Z. At point in time t1 the value of the control signal is increased from second control value 64 to first control value 66. This causes quantity control valve 30 to transition from open state 60 into closed state 62, and to close at point in time 104. Quantity control valve 30 remains closed during a holding phase 106. Due to the pressure in delivery space 28 which keeps quantity control valve 30 closed, the control signal may assume second control value 64 during a time period 108, i.e., being de-energized. The value of the control signal is increased back to first control value 66 before delivery piston 24 reaches top dead center 120, i.e., before outlet valve 32 opens 122. At point in time 82 the control signal is switched in the form of the descending progression illustrated in FIG. 4.

In order to effectively decelerate the motion of activating plunger 48 during closing, according to the present invention it is recognized that at the point in time when the pressure in delivery space 28 has dropped so far that it no longer holds quantity control valve 30 in closed state 62, the value of the control signal must be sufficiently close to first control value 66. This is achieved according to the present invention in that first point in time 82 and/or second point in time 83 is/are temporally after top dead center 120 and/or after outlet valve 32 opens 122.

As an alternative to the specific embodiment shown, it is possible for the control signal to be held, for example continuously, at first control value 66 during time period 108.

What is claimed is:

1. A method for controlling a quantity control valve configured to move to a closed state when controlled by a first control value of a control signal and move to an open state when controlled by a second control value of the control signal, the method comprising:

continuously decreasing the control signal from a first signal value at a first point in time to a second signal value at a second point in time; and subsequently continuously decreasing the control signal from the second signal value at the second point in time to the second control value at a third point in time;

wherein the quantity control valve is:

in the closed state, not allowing fluid to enter a delivery space, at the first point in time;

starts to open, beginning to allow fluid to enter the delivery space, at the second point in time;

completely open in an open state, allowing fluid to enter the delivery space, before the third point in time;

in the closed state for control signal values above the first signal value; and not in the closed state for control signal values below the second signal value, as a result of at least one of (i) a predefined first time interval between the second point in time and the first point in time, and (ii) a predefined second time interval between the second point in time and the third point in time.

2. A method for controlling a quantity control valve configured to move to a closed state when controlled by a first control value of a control signal and move to an open state when controlled by a second control value of the control signal, the method comprising:

continuously decreasing the control signal from a first signal value at a first point in time to a second signal value at a second point in time;

subsequently continuously decreasing the control signal from the second signal value at the second point in time to the second control value at a third point in time; and prior to continuously decreasing the control signal from the first signal value at the first point in time, increasing the control signal from the second control value to the first control value in order to put the quantity control valve in the closed state at a preliminary closing time prior to the first point in time, wherein the control signal temporarily moves to the second control value in a portion of the time period following the preliminary closing time and prior to the first point in time, wherein the quantity control valve is:

in the closed state at the first point in time;

starts to open at the second point in time;

completely open before the third point in time;

in the closed state for control signal values above the first signal value; and not in the closed state for control signal values below the second signal value, as a result of at least one of (i) a predefined first time interval between the second point in time and the first point in time, and (ii) a predefined second time interval between the second point in time and the third point in time.

3. The method as recited in claim 1, further comprising:

prior to continuously decreasing the control signal from the first signal value at the first point in time, increasing the control signal from the second control value to the first control value in order to put the quantity control valve in the closed state at a preliminary closing time prior to the first point in time, wherein the control signal is continuously held at the first control value in the time period between the preliminary closing time and the first point in time.

4. The method as recited in claim 1, wherein the time interval between the third point in time and the second point in time is greater by a predetermined factor than a time required for the quantity control valve to transition from the closed state to the open state at a control signal value below the second control value.

5. The method as recited in claim 1, wherein the time interval between the second point in time and the first point in time is greater by a predetermined factor than a time required for the quantity control valve to transition from the closed state to the open state at a control signal value below the second control value.

6. The method as recited in claim 1, wherein the quantity control valve is part of a high-pressure pump having an outlet valve, and wherein at least one of the first point in time and the second point in time is one of after a top dead center of the high-pressure pump or after a point in time when the outlet valve opens.

7. The method as recited in claim 1, wherein the quantity control valve includes an electromagnetic actuator, and wherein the first control value of the control signal corresponds to an energized state of the actuator, and the second control value of the control signal corresponds to a de-energized state of the actuator.

8. A non-transitory computer-readable data storage medium storing a computer program having program codes which, when executed on a computer, performs a method for controlling a quantity control valve configured to move to a closed state when controlled by a first control value of a control signal and move to an open state when controlled by a second control value of the control signal, the method comprising:

continuously decreasing the control signal from a first signal value at a first point in time to a second signal value at a second point in time; and subsequently continuously decreasing the control signal from the second signal value at the second point in time to the second control value at a third point in time;

wherein the quantity control valve is:

in the closed state, not allowing fluid to enter a delivery space, at the first point in time;

starts to open, beginning to allow fluid to enter the delivery space, at the second point in time;

completely open in an open state, allowing fluid to enter the delivery space, before the third point in time;

in the closed state for control signal values above the first signal value; and not in the closed state for control signal values below the second signal value, as a result of at least one of (i) a predefined first time interval between the second point in time and the first point in time, and (ii) a predefined second time interval between the second point in time and the third point in time.

9. A control device for controlling a quantity control valve configured to move to a closed state when controlled by a first control value of a control signal and move to an open state when controlled by a second control value of the control signal, the control device comprising:

means for continuously decreasing the control signal from a first signal value at a first point in time to a second signal value at a second point in time; and means for subsequently continuously decreasing the control signal from the second signal value at the second point in time to the second control value at a third point in time;

wherein the quantity control valve is:

in the closed state, not allowing fluid to enter a delivery space, at the first point in time;

starts to open, beginning to allow fluid to enter the delivery space, at the second point in time;

completely open in an open state, allowing fluid to enter the delivery space, before the third point in time;

in the closed state for control signal values above the first signal value; and not in the closed state for control signal values below the second signal value, as a result of at least one of (i) a predefined first time interval between the second point in time and the first point in time, and (ii) a predefined second time interval between the second point in time and the third point in time.

10. The method as recited in claim 1, wherein the quantity control valve starts to open at a limiting control value.

11. The method as recited in claim 10, wherein a variance range of the limiting control value is determined, the variance range having an upper variance limit and a lower variance limit.

12. The method as recited in claim 11, wherein the first signal value is greater than the upper variance limit.

13. The method as recited in claim 11, wherein the second signal value is less than the lower variance limit.

14. The method of claim 1, wherein the time interval between the third point in time and the second point in time is greater by a predetermined factor than a time required for the quantity control valve to close when controlled by the second control value.

15. The method of claim 1, wherein the time interval between the second point in time and the first point in time is greater by a predetermined factor than a time required for the quantity control valve to close when controlled by the second control value.

* * * * *